US008026204B2

(12) United States Patent
Fujioka et al.

(10) Patent No.: US 8,026,204 B2
(45) Date of Patent: Sep. 27, 2011

(54) METHOD FOR PRODUCING ANIONIC SURFACTANT GRANULE

(75) Inventors: Toku Fujioka, Wakayama (JP); Tatsuki Matsumoto, Wakayama (JP); Hisashi Goda, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/667,368

(22) PCT Filed: Jul. 9, 2008

(86) PCT No.: PCT/JP2008/062775

§ 371 (c)(1),
(2), (4) Date: Dec. 30, 2009

(87) PCT Pub. No.: WO2009/011348

PCT Pub. Date: Jan. 22, 2009

(65) Prior Publication Data

US 2011/0000987 A1 Jan. 6, 2011

(30) Foreign Application Priority Data

Jul. 13, 2007 (JP) ..... 2007-184282

(51) Int. Cl.
*C11D 17/00* (2006.01)

(52) U.S. Cl. ..... 510/444; 510/445; 510/446; 510/452

(58) Field of Classification Search ..... None
See application file for complete search history.

(56) References Cited

U.S. PATENT DOCUMENTS

| | | | | |
|---|---|---|---|---|
| 5,052,122 | A | 10/1991 | Ishikawa et al. | |
| 5,720,439 | A | 2/1998 | Nakázawa et al. | |
| 2005/0043202 | A1 * | 2/2005 | Umehara et al. | 510/444 |
| 2005/0106118 | A1 | 5/2005 | Sakuma et al. | |

FOREIGN PATENT DOCUMENTS

| | | | |
|---|---|---|---|
| EP | 1016450 | A1 | 7/2000 |
| EP | 1016451 | A1 | 7/2000 |
| JP | 55-69698 | A | 5/1980 |
| JP | 2-222498 | A | 9/1990 |
| JP | 3-165700 | A | 7/1991 |
| JP | 5-106428 | A | 4/1993 |
| JP | 5-339037 | A | 12/1993 |
| JP | 10-296064 | A | 11/1998 |
| JP | 10296065 | A | 11/1998 |
| JP | 2003-292990 | A | 10/2003 |
| JP | 2004-83682 | A | 3/2004 |
| JP | 2005-68413 | A | 3/2005 |

OTHER PUBLICATIONS

Chinese Application No. 200880024179.7, Office Action, Dec. 31, 2010, pp. 1-4.
European Application No. 08 77 8192; Search Report; Apr. 15, 2011, pp. 1-4.

* cited by examiner

*Primary Examiner* — Necholus Ogden, Jr.
(74) *Attorney, Agent, or Firm* — Birch, Stewart, Kolasch & Birch, LLP

(57) ABSTRACT

The present invention relates to a method for producing an anionic surfactant granule, which includes granulating an anionic surfactant powder in a granulator having an agitating blade, while adding water, at a temperature of the granule being higher by 0.5 to 30° C. than a boiling point of water under a pressure of the inside of the granulator.

11 Claims, No Drawings

METHOD FOR PRODUCING ANIONIC SURFACTANT GRANULE

FIELD OF THE INVENTION

The present invention relates to a method for producing an anionic surfactant granule.

BACKGROUND OF THE INVENTION

Anionic surfactants are mixed with other surfactant or a builder to be used in laundry detergents and kitchen detergents, foaming agents for toothpaste, emulsifiers for medicines and cosmetics, and other detergents.

There have been known forms of an anionic surfactant, including granule produced by drying an aqueous solution, slurry, or paste of an anionic surfactant (hereinafter, simply referred to as the aqueous solution group of anionic surfactant), and products therefrom such as powder, needle, noodle, and flake. A conventional method for producing an anionic surfactant granule includes drying an aqueous solution etc. of an anionic surfactant as a starting material to remove water, and then optionally processing a dried product by a secondary processing such as crushing and granulating.

Conventional methods for producing an anionic surfactant granule include, for example, spray-drying such as a method of spray-drying a low concentration slurry containing water in an amount of 60 to 70% by weight (JP-A55-69698 and JP-A53-39037) and a method of spray-drying a high concentration slurry of an alkylsulfate having a solid content of 60 to 80% by weight (JP-A54-106428). JP-A2-222498 discloses a method of drying a high concentration paste raw material for detergent containing water in an amount of 20 to 35% by weight with a vacuum thin film dryer.

SUMMARY OF THE INVENTION

The present invention provides a method for producing an anionic surfactant granule, including granulating an anionic surfactant powder in a granulator having an agitating blade (agitating impeller or stirring impeller), while adding water, at a temperature of the granule being higher by 0.5 to 30° C. than a boiling point of water under a pressure of the inside of the granulator.

DETAILED DESCRIPTION OF THE INVENTION

Important properties of an anionic surfactant granule include quick dissolving in use and uniformly dispersing in a mixture with other powder materials when used as a mixture. From these reasons, an average particle diameter of the anionic surfactant granule is preferably small. Since fine powder is dispersed in the air in handling, an amount of the fine powder in the granule is preferably small. It is more preferable that the granule has a good fluidity.

Anionic surfactant granules produced by spray-drying methods of patent References and further crushing have problems of a large amount of fine powder and poor fluidity.

The present invention provides an anionic surfactant granule having an adequate particle diameter, containing a small amount of fine powder, and having good fluidity.

The anionic surfactant granule produced by the method of the present invention contains a small amount of fine powder and has good fluidity.

The present invention specifically relates to a method for producing an anionic surfactant granule suitably used in detergents for clothing and kitchen, foaming agents for tooth paste, shampoo powders, emulsifiers for emulsion polymerization, emulsifiers for medicines and cosmetics, and foaming agents for cement, and the like.

[Anionic Surfactant]

Examples of the anionic surfactant used in the present invention, not limited particularly, include alkyl- or alkenyl-sulfates, polyoxyalkylene alkyl or alkenyl ether sulfates, α-olefin sulfonate, alkylbenzenesulfonates, α-sulfofatty acid salts and ester salts, and alkyl or alkenyl ether carboxylates. Among these anionic surfactants, from the viewpoints of foaming properties and detergent performance, preferred are alkyl- or alkenyl-sulfates and polyoxyalkylene (alkyl or alkenyl)ether sulfates, and more preferred are alkyl- or alkenyl-sulfates. Examples of the salt include alkaline metal salts, alkaline earth metal salts, ammonium salts, and alkanolamine salts. Among these salts, preferred are alkaline metal salts including a sodium salt, a potassium salt and mixtures thereof.

Among these anionic surfactants, particularly preferred is at least one sulfate selected from an alkyl- or alkenyl-sulfate represented by the formula (I) and a polyoxyalkylene (alkyl or alkenyl)ether sulfate represented by the formula (II), and more preferred is the alkyl- or alkenyl-sulfate represented by the formula (I):

$$(R^1O—SO_3)pM^1 \quad (I)$$

where $R^1$ represents a linear or branched alkyl or alkenyl group having 8 to 24 carbon atoms; $M^1$ represents a cation; and p represents a valence number of $M^1$ that is 1 or 2, $$(R^2O\text{-}(AO)mSO_3)qM^2 \quad (II)$$

where $R^2$ represents a linear or branched alkyl or alkenyl group having 8 to 24 carbon atoms; A represents an alkylene group having 2 to 4 carbon atoms, and m A's may be same or different; m represent an average addition mole number of alkylene oxide ranging from 0.05 to 20; $M^2$ represents a cation; and q represents a valence number of $M^2$ that is 1 or 2.

From the viewpoints of anti-caking properties and solubility of the granule, in formulae (I) and (II), carbon numbers of $R^1$ and $R^2$ are each preferably 8 to 20, and more preferably 10 to 18. A is preferably an alkylene group having 2 to 4 carbon atoms, and more preferably having 2 carbon atoms. From the viewpoints of good powder characteristics including anti-caking properties, m is preferably 0.05 to 2, more preferably 0.1 to 1, and even more preferably 0.2 to 0.8. $M^1$ and $M^2$ each preferably represent an alkaline metal atom such as Na and K, an alkaline earth metal atom such as Ca and Mg, or an alkanol-substituted or unsubstituted ammonium group, more preferably an alkaline metal atom, and even more preferably Na.

The alkyl- or alkenyl-sulfate represented by the formula (I) can be produced by sulfating an alcohol having 8 to 24 carbon atoms and preferably 8 to 20 carbon atoms (hereinafter, referred to as the higher alcohol) and neutralizing. The polyoxyalkylene alkyl or alkenyl ether sulfate represented by the formula (II) can be produced by, for example, sulfating an alkylene oxide adduct to a higher alcohol having an average addition mole number of 0.05 to 20, preferably 0.05 to 2, and neutralizing the resultant.

[Anionic Surfactant Granule]

From the viewpoint of an efficient exhibition of functions of the anionic surfactant itself, the anionic surfactant granule of the present invention preferably contains the anionic surfactant in an amount of not less than 80% by weight, more preferably not less than 90% by weight, and even more preferably not less than 95% by weight of the whole amount thereof.

The anionic surfactant granule of the present invention may further contain a water-soluble inorganic salt in addition to the anionic surfactant. Examples of the water-soluble inorganic salt include sodium chloride, sodium sulfate, and sodium carbonate. A content of the water-soluble inorganic salt in the anionic surfactant granule of the present invention is not specifically limited, but preferably not more than 10 parts by weight, and more preferably not more than 2 parts by weight to 100 parts by weight of the anionic surfactant, for keeping a solid content of the anionic surfactant at high level.

The anionic surfactant granule of the present invention can further contain other surfactant than the anionic surfactant. Examples of the other surfactant than the anionic surfactant include cationic and nonionic surfactants.

A water content in the anionic surfactant granule of the present invention is preferably 0.3 to 2.5% by weight, more preferably not more than 2.0% by weight from the viewpoint of anti-caking properties, and also more preferably not less than 0.5% by weight from the viewpoint of reduced amount of dust. A water content in a granule is measured by methods such as weight reduction by heating, distillation, and Karl Fischer titration (JIS K 0068). In the present invention, a water content is a value measured by Karl Fischer titration (JIS K 0068).

From the viewpoints of solubility and handiness, an average particle diameter of the anionic surfactant granule of the present invention is preferably 0.1 mm to 5.0 mm, more preferably 0.2 to 3.0 mm, and even more preferably 0.2 to 2.0 mm.

In the specification, an average particle diameter of the anionic surfactant granule is determined by vibrating the granule in JIS Z 8801 standard sieves for 5 minutes and calculating weight percentages of particles remaining in sieves having different mesh sizes.

[Method for Producing an Anionic Surfactant Granule]

The method for producing an anionic surfactant granule of the present invention includes granulating an anionic surfactant powder in a granulator having an agitating blade with adding water at a temperature of the granule being higher by 0.5 to 30° C. than a boiling point of water under a pressure of the inside of the granulator.

From the viewpoints of purity and anti-caking properties of the granule, an amount of the unreacted in the starting powder is preferably not more than 5% by weight, and more preferably not more than 2% by weight to the anionic surfactant. Use of the starting powder containing smaller amount of the unreacted tends to result in a product having smaller particle diameters, and thus the amount is more preferably not more than 1.5% by weight, even more preferably not more than 1.3% by weight, and still even more preferably not more than 1.0% by weight. As used herein, the unreacted include an alcohol not sulfated in production of the anionic surfactant, an alkoxylate, and a trace amount of side products of the production such as hydrocarbons and wax.

From the viewpoints of an easy controlling of a drying velocity and a particle size of a final product and handling, an average particle diameter of the starting powder is preferably 0.03 to 0.5 mm, and more preferably 0.05 to 0.4 mm.

In the specification, an average particle diameter of the starting powder is a value measured with Air Jet Sieve 200 LS-N (Hosokawa Micron Corporation).

Examples of a pulverizer used for producing the starting powder include Atomizer (Fuji Paudal Co., Ltd.), Fitz Mill (Dalton Co., Ltd.), Pulverizer (Dalton Co., Ltd.), Power Mill (Powrex Corporation), and Comil (Quadro Engineering).

In the production method of the present invention, from the viewpoint of production of a granule having a preferable particle size, granulation is performed at a temperature of the granule in a granulator, being higher by 0.5 to 30° C., more preferably 1 to 20° C., even more preferably 1 to 17° C., than a boiling point of water under a pressure in the granulator. The reason of granulation preferably performed at the 0.5 to 30° C. higher temperature than the boiling point of water is supposed as that a water content of the granule is kept at 0.3 to 2.5% by weight suitable for granulation. It is also supposed that granulation performed with adding water causes a wetter surface of the granule than an average water amount in the granule to easily exhibit thermal flexibility of the surface of the granule, which situation contributes to preferable granulation.

In some cases, low temperature of the granule in the granulator requires high vacuum and large energy, and high temperature of the granule decreases productivity, which simultaneously requires a heat source of high temperature, and has increased risk of pyrolysis. A temperature of the granule is thus preferably not less than 0° C., more preferably not less than 20° C., and even more preferably not less than 30° C., and also preferably not more than 100° C., more preferably not more than 85° C., even more preferably not more than 75° C., and still even more preferably not more than 70° C. Granulation is preferably performed with controlling a variation of temperature of the granule within ±5° C., more preferably within ±2° C., even more preferably within ±1° C.

Such changes in the temperature can be controlled appropriately by controlling an added amount of water and an adding rate of water, a pressure in the granulator, a temperature of a jacket in the granulator and a Froude number of an agitating blade of the granulator.

From the viewpoint of a low temperature of materials during operation to suppress an aqueous solution and granulated products from decomposing, the pressure in the granulator is preferably not more than 40 kPa, more preferably not more than 30 kPa, and even more preferably not more than 20 kPa. From the viewpoints of load on a vacuum pump and airtightness of the granulator, the pressure is preferably not less than 0.67 kPa, more preferably not less than 1.5 kPa, and even more preferably not less than 3.0 kPa.

Examples of a heat source of the granulator include a warm water jacket and electrical heater tracing, in which a warm water jacket is preferable. A temperature of the jacket is preferably not more than 100° C., and from the viewpoint of application to heat-sensitive materials, more preferably not more than 90° C.

In the present invention, water added into the granulator may contain an anionic surfactant, an activating agent other than the anionic surfactant, and a water-soluble inorganic salt. A total content thereof is not specifically limited, but from the viewpoint of keeping an effective content of the anionic surfactant granule at high level, is not more than 50 parts by weight, and preferably not more than 10 parts by weight to 100 parts by weight of water.

From the viewpoints of granulation and temperature control, an average adding rate of water is preferably 0.001 to 10 kg/hr, more preferably 0.01 to 5 kg/hr, and even more preferably 0.02 to 2 kg/hr per kg of starting powder of the anionic surfactant in the granulator.

The granulator used in the present invention has an agitating blade, and may further have a chopper blade (crushing impeller). Examples of the granulator preferably used in the present invention include batch granulators such as Henschel mixer [Mitsui Miike Kakouki Kabushiki Kaisha], High-speed mixer [Fukae Powtec Co., Ltd.], Vertical Granulator [Powrex Corporation], Loedige Mixer [Matsuzaka Giken Kabushiki Kaisha], and Ploughshare Mixer [Pacific Machinery & Engineering Co., Ltd.] and continuous granulators such as a continuous loedgie mixer (middle speed mixer: relatively long residence time), CB Recycler (Loedige Maschinenbau GmbH, high speed mixer: relatively short residence time), Turbulizer (Hosokawa Micron Corporation), Schugi Mixer (Powrex Corporation), and Flow Jet Mixer (Funken Powtechs, Inc.). Among batch granulators, particularly preferred are Loedige Mixer [Matsuzaka Giken Kabushiki Kaisha], High-speed mixer [Fukae Powtec Co., Ltd.], and Ploughshare Mixer [Pacific Machinery & Engineering Co., Ltd.].

The granulator used in the present invention preferably further has a jacket for controlling a temperature of the inside (a temperature of materials) and/or a nozzle for blowing a gas. Specific examples of such a preferred granulator include those described in JP-A10-296064, JP-A10-296065, and JP-B3165700.

EXAMPLES

The following Examples demonstrate the present invention. Examples are intended to illustrate the present invention and not to limit the present invention.

In Examples, "%" indicates the "% by weight" unless otherwise noted.

Example 1

In a 2500 L granulator [Fukae Powtec Co., Ltd., FMD-1200JE] having an agitating blade and a crushing blade, 300 kg of sodium alkylsulfate powder [EMAL 0: Kao Corporation, average particle diameter: 0.31 mm] was subjected to granulation under conditions of a jacket temperature of 65° C., an inside pressure of 16 kPa, a rotation number of the agitating blade of 70 r/min, and a rotation number of the crushing blade of 1000 r/min, with supplying water in such rate as that a temperature of a granule was 60±2° C. In Example 1, a boiling point of water under the inner pressure was 55.3° C. Granulation was performed for 2.0 hours. An average supplying rate of water was 14.8 kg/hr. An average adding rate of water per kg of sodium alkylsulfate powder in the granulator was 0.049 kg/hr. Granulation produced a transparent granule of sodium alkylsulfate having an average particle diameter of 1.08 mm without fine powder.

Example 2

In the same granulator as used in Example 1, 300 kg of sodium alkylsulfate powder [EMAL 0: Kao Corporation, average particle diameter: 0.06 mm] was subjected to granulation under conditions of a jacket temperature of 65° C., an inside pressure of 5.3 kPa, a rotation number of the agitating blade of 70 r/min, and a rotation number of the crushing blade of 0 r/min, with supplying water in such rate as that a temperature of a granule was 35.3±2° C. In Example 2, a boiling point of water under the inner pressure was 33.9° C. Granulation was performed for 6.0 hours. An average supplying rate of water was 28.8 kg/hr. An average adding rate of water per kg of sodium alkylsulfate powder in the granulator was 0.096 kg/hr. Granulation produced a transparent granule of sodium alkylsulfate having an average particle diameter of 0.84 mm without fine powder.

Example 3

In a 65 L granulator [Fukae Powtec Co., Ltd., FMD-65J] having an agitating blade and a crushing blade, 10 kg of sodium alkylsulfate powder [EMAL 10P-HD: Kao Corporation, average particle diameter: 0.09 mm] was subjected to granulation under conditions of a jacket temperature of 75° C., an inside pressure of 5.3 kPa, a rotation number of the agitating blade of 200 r/min, and a rotation number of the crushing blade of 2000 r/min, with supplying water in such rate as that a temperature of a granule was 46±2° C. In Example 3, a boiling point of water under the inner pressure was 33.9° C. Granulation was performed for 0.5 hours. An average supplying rate of water was 6.1 kg/hr. An average adding rate of water per kg of sodium alkylsulfate powder in the granulator was 0.61 kg/hr. Granulation produced a transparent granule of sodium alkylsulfate having an average particle diameter of 0.41 mm without fine powder.

Example 4

In a 65 L granulator [Fukae Powtec Co., Ltd., FMD-65J] having an agitating blade and a crushing blade, 10 kg of sodium alkylsulfate powder [EMAL 10P-HD: Kao Corporation, average particle diameter: 0.09 mm] was subjected to granulation under conditions of a jacket temperature of 75° C., an inside pressure of 5.3 kPa, a rotation number of the agitating blade of 200 r/min, and a rotation number of the crushing blade of 2000 r/min, with supplying water in such rate as that a temperature of a granule was 57±2° C. In Example 4, a boiling point of water under the inner pressure was 33.9° C. Granulation was performed for 1.5 hours. An average supplying rate of water was 2.8 kg/hr. An average adding rate of water per kg of sodium alkylsulfate powder in the granulator was 0.28 kg/hr. Granulation produced a transparent granule of sodium alkylsulfate having an average particle diameter of 0.40 mm without fine powder.

Comparative Example 1

In the same granulator as used in Example 1, 580 kg of sodium alkylsulfate powder [EMAL 0: Kao Corporation, average particle diameter: 0.05 mm] was subjected to granulation under conditions of a jacket temperature of 90° C., an inside pressure of 4.0 kPa, a rotation number of the agitating blade of 70 r/min, and a rotation number of the crushing blade of 2000 r/min at a temperature of granule of 115° C., without supplying water. In Comparative Example 1, a boiling point of water under the inner pressure was 29.0° C. Granulation was performed for 6.5 hours. However, a product had a particle diameter of 0.05 mm, and a granule was not produced.

Comparative Example 2

In the same granulator as used in Example 1, 300 kg of sodium alkylsulfate powder [EMAL 0: Kao Corporation, average particle diameter: 0.03 mm] was subjected to granulation under conditions of a jacket temperature of 65° C., an inside pressure of 5.2 kPa, a rotation number of the agitating blade of 70 r/min, and a rotation number of the crushing blade of 0 r/min, with supplying water in such rate as that a temperature of a granule was 34±2° C. In Comparative Example 2, a boiling point of water under the inner pressure was 33.6° C. Granulation was performed for 6.0 hours. An average supplying rate of water was 47 kg/hr. An average adding rate of water per kg of sodium alkylsulfate powder in the granulator was 0.16 kg/hr. Granulation produced a granule having a particle diameter of 100 mm (baseball size). A granule having a preferred particle size was not produced.

Conditions of production and average particle diameters of produced anionic surfactant granules of Examples 1 to 4 and Comparative Examples 1 to 2 are shown in Table 1.

TABLE 1

| | | | Example 1 | Example 2 | Example 3 | Example 4 | Comparative example 1 | Comparative example 1 |
|---|---|---|---|---|---|---|---|---|
| Granulation condition | Inner pressure | [kPa] | 16.0 | 5.3 | 5.3 | 5.3 | 4.0 | 5.2 |
| | Boiling point of water (T1) | [° C.] | 55.3 | 33.9 | 33.9 | 33.9 | 29.0 | 33.6 |
| | Temperature of granule (T2) | [° C.] | 60.0 | 35.3 | 45.7 | 57.3 | 115 | 34.0 |
| | Temperature difference (T2 – T1) | [° C.] | 4.7 | 1.4 | 11.8 | 23.4 | 86.0 | 0.4 |
| | Jacket temperature | [° C.] | 65 | 65 | 75 | 75 | 90 | 65 |
| | Rotation number of agitating blade | [r/min] | 70 | 70 | 200 | 200 | 70 | 70 |
| | Rotation number of chopper blade | [r/min] | 1000 | 0 | 2000 | 2000 | 2000 | 0 |
| | Granulation time | [hr] | 2.0 | 6.0 | 0.5 | 1.5 | 6.5 | 6.0 |
| Average particle diameter of starting powder | | [mm] | 0.31 | 0.06 | 0.09 | 0.09 | 0.05 | 0.03 |
| Average adding rate of water (per kg of starting powder) | | [kg/hr] | 0.049 | 0.096 | 0.61 | 0.28 | — | 0.16 |
| Average particle diameter of anion surfactant granule | | [mm] | 1.08 | 0.84 | 0.41 | 0.40 | 0.05 | 100 |

The invention claimed is:

1. A method for producing an anionic surfactant granule, comprising granulating an anionic surfactant powder in a granulator having an agitating blade, while adding water, at a temperature of the granule being higher by 0.5 to 30° C. than a boiling point of water under a pressure of the inside of the granulator.

2. The method according to claim 1, wherein a temperature of the granule in the granulator is 0 to 100° C.

3. The method according to claim 1, wherein an inner pressure of the granulator is 0.67 to 40 kPa.

4. The method according to claim 1, wherein the anionic surfactant is an alkyl- or alkenyl-sulfate represented by the formula (I):

$$(R^1O—SO_3)_pM^1 \quad (I)$$

where $R^1$ represents a linear or branched alkyl or alkenyl group having 8 to 24 carbon atoms; $M^1$ represents a cation; and p represents a valence number of $M^1$ that is 1 or 2.

5. The method according to claim 1, wherein the granulator having an agitating blade further has a crushing blade.

6. The method according to claim 2, wherein an inner pressure of the granulator is 0.67 to 40 kPa.

7. The method according to claim 2, wherein the anionic surfactant is an alkyl- or alkenyl-sulfate represented by the formula (I):

$$(R^1O—SO_3)_pM^1 \quad (I)$$

where $R^1$ represents a linear or branched alkyl or alkenyl group having 8 to 24 carbon atoms; $M^1$ represents a cation; and p represents a valence number of $M^1$ that is 1 or 2.

8. The method according to claim 3, wherein the anionic surfactant is an alkyl- or alkenyl-sulfate represented by the formula (I):

$$(R^1O—SO_3)_pM^1 \quad (I)$$

where $R^1$ represents a linear or branched alkyl or alkenyl group having 8 to 24 carbon atoms; $M^1$ represents a cation; and p represents a valence number of $M^1$ that is 1 or 2.

9. The method according to claim 2, wherein the granulator having an agitating blade further has a crushing blade.

10. The method according to claim 3, wherein the granulator having an agitating blade further has a crushing blade.

11. The method according to claim 4, wherein the granulator having an agitating blade further has a crushing blade.

* * * * *